US009278036B2

(12) United States Patent
Lee

(10) Patent No.: US 9,278,036 B2
(45) Date of Patent: Mar. 8, 2016

(54) ELECTRIC WHEELCHAIR

(76) Inventor: Siu Lun Lee, Hong Kong (CN)

( * ) Notice: Subject to any disclaimer, the term of this patent is extended or adjusted under 35 U.S.C. 154(b) by 0 days.

(21) Appl. No.: 13/583,782

(22) PCT Filed: Apr. 6, 2012

(86) PCT No.: PCT/CN2012/073568

§ 371 (c)(1),
(2), (4) Date: Sep. 10, 2012

(87) PCT Pub. No.: WO2013/049979

PCT Pub. Date: Apr. 11, 2013

(65) Prior Publication Data

US 2014/0202777 A1 Jul. 24, 2014

(30) Foreign Application Priority Data

Oct. 4, 2011 (HK) ..... 11110454.5

(51) Int. Cl.
*A61G 5/06* (2006.01)
*A61G 5/04* (2013.01)

(52) U.S. Cl.
CPC *A61G 5/061* (2013.01); *A61G 5/04* (2013.01); *A61G 5/046* (2013.01); *A61G 5/066* (2013.01); *A61G 2203/14* (2013.01)

(58) Field of Classification Search
CPC ..... A61G 5/061; A61G 5/04; A61G 5/066
USPC ..... 180/9.1, 9.32, 9.5, 9.52, 8.2, 907, 8.7, 180/6.7, 326; 280/5.22
See application file for complete search history.

(56) References Cited

U.S. PATENT DOCUMENTS

| | | | | |
|---|---|---|---|---|
| 3,195,910 | A | 7/1965 | Steiner | |
| 4,077,483 | A * | 3/1978 | Randolph | 180/6.5 |
| 4,566,551 | A | 1/1986 | Feliz | |
| 5,395,129 | A * | 3/1995 | Kao | 280/5.22 |
| 6,076,619 | A * | 6/2000 | Hammer | 180/6.48 |
| 7,159,677 | B1 * | 1/2007 | Lam et al. | 180/65.51 |
| 7,316,405 | B2 * | 1/2008 | Kritman et al. | 280/5.22 |
| 2003/0116927 | A1 | 6/2003 | Quigg | |

(Continued)

FOREIGN PATENT DOCUMENTS

| | | |
|---|---|---|
| CN | 2154677 Y | 2/1994 |
| CN | 2320234 Y | 5/1999 |
| CN | 1720886 A | 1/2006 |

(Continued)

*Primary Examiner* — Joseph Rocca
*Assistant Examiner* — Jacob Knutson
(74) *Attorney, Agent, or Firm* — Rabin & Berdo, P.C.

(57) ABSTRACT

An electric wheelchair comprising a movable seat part (1), a body part (2) served as a support for the seat part, a seat adjustment mechanism (3) arranged under the seat part, a bottom part (4), and a crawler moving mechanism (5). The crawler moving mechanism (5) comprises two sets of crawlers arranged respectively at both sides underneath the bottom part, and each of which comprises a front crawler and a rear crawler. The bottom part (4) is comprised of a front portion and a rear portion, which are movably connected with a coupling arrangement and capable of deflection with respect to each other. The crawler moving mechanism (5) further comprises movable stretching crawlers arranged respectively at outside of the front crawler, and fixed stair-climbing crawlers arranged respectively at outside of the rear crawler, wherein a free end of the fixed stair-climbing crawler forms a specific angle relative to the rear crawler.

13 Claims, 8 Drawing Sheets

(56) References Cited

U.S. PATENT DOCUMENTS

| | | | | |
|---|---|---|---|---|
| 2003/0183428 | A1 | 10/2003 | Hedeen | |
| 2004/0188979 | A1 * | 9/2004 | Bernatsky et al. | 280/304.1 |

FOREIGN PATENT DOCUMENTS

| | | | |
|---|---|---|---|
| CN | 10 1007549 | A | 8/2007 |
| CN | 101077717 | A | 11/2007 |
| CN | 201079509 | Y | 7/2008 |
| CN | 101283944 | A | 10/2008 |
| CN | 201316363 | Y | 9/2009 |
| CN | 201492595 | U | 6/2010 |
| CN | 201558239 | U | 8/2010 |
| CN | 201870836 | U | 6/2011 |
| JP | 10328241 | A | 12/1998 |
| JP | 2000-060906 | A | 2/2000 |
| WO | WO-2004039612 | A3 | 10/2004 |

* cited by examiner

ELECTRIC WHEELCHAIR

TECHNICAL FIELD

The present invention relates to an electric wheelchair, and particularly to an electric wheelchair having a stair-climbing function and capable of going up and down the stairs, slopes, or climbing over obstacles in a safe and stable manner.

BACKGROUND OF THE INVENTION

There are wheelchairs of various designs for a person with a mobility disability, of which some are designed for climbing stairs. Most of the designs make use of complicated wheels, combinations of movable crawlers and wheels, or other devices, and coupled with electronic sensors, hydraulic armed levers, and the like, whereby making the manufacturing cost very high. In addition, some of the designs have serious safety issues, or they are bulky and very inconvenient to use, and several designs might require assistance from other person while going up and down the stairs.

Chinese utility model patent no. 201079509Y discloses a crawler type stair climbing chair comprising a seat, a seat bracket, wheels and a crawler moving mechanism arranged under the seat bracket, and an automatic balancing mechanism arranged under the seat, wherein the crawler moving mechanism is driven by an electric driver, and comprises crawlers for up-stair crawlers and down-stair crawlers, and the rear side of the down-stair crawlers forms a specific angle with the ground surface. Though the automatic balancing mechanism is employed to maintain the balance of the seat, but the design ignores leverage issues of the fulcrum and the point of force and the seat lacks an automatic locking mechanism, so that its line of center of gravity and the fulcrum are too close while going up and down the stairs. If the passenger slightly leans forward, the chairs will tend to lean forward and the risk of turnover is increased. In addition, as the position of the crawlers can not be adjusted, the stair climbing chair might be in the risk of tripping over while traveling over an obstacle on the ground.

Chinese utility model patent no. 201316363Y discloses a wing shaped stair climbing vehicle employing wheels and a crawler moving mechanism, which realizes a continuous stair climbing by means of a combination of a reduction gear and a DC motor. The crawler moving mechanism comprises moving crawlers, climbing crawlers and auxiliary crawlers, wherein the climbing crawlers are arranged at both sides of the front end of the frame of the vehicle, which can be controlled for rotatably retraction in a certain angle range; and the auxiliary crawlers are arranged at both sides of the rear end of the frame of the vehicle, which can be also controlled for rotatably retraction in a certain angle range. Though the vehicle can move smoothly while going up or down the stairs, the vehicle has a flat bottom such that the body of the vehicle might suddenly fall quickly when the vehicle is about to reach the level ground, particularly the top of a stair case, which might cause impact and danger to the passenger. Even there are front and rear auxiliary crawlers, the passenger is hard to simultaneously take into account the front and rear crawlers and the travel direction thereof. Moreover, such vehicle is bulky in appearance and inconvenient to operate and manipulate.

When the chair or vehicle climb up the top of the stair case, its body will be significantly tilted, such that the foregoing or other electric wheelchairs employ a movable seat to solve the issue, but most of them have ignored the leverage issues of the fulcrum and the point of force, and considered the issues could be fixed by moving the seat correspondingly, and even without thinking of locking the seat, which might cause hidden problems for safety thereof.

When the crawler type wheelchair reaches the top of the stair case, the body of the vehicle will fall suddenly due to the change of center of gravity, which might cause impact and danger to the passenger thereon. Therefore, some products will make use of a number of complex mechanical devices to solve this problem, thereby rendering a substantial increase in the cost.

There exist also several products being complicated in design, which results in a relatively large size, such that it is inconvenient to use them for traveling on the ground or going up and down the stairs.

SUMMARY OF THE INVENTION

In order to obviate, at least partially, the drawbacks existed in the prior art electric wheelchairs, the present invention provides an electric wheelchair, which has the following advantages:

- at both sides of bottom of a movable seat of the electric wheelchair of the present invention a set of rollers is respectively arranged, by which the body weight of the passenger could be evenly distributed on a body part of the electric wheelchair, such that the seat could be moved more smoothly and safely;
- anti-reverse gear assembly and a safety locking device are arranged for providing a double safety assurance to the passenger, and making the seat to be more flexible and practical for use, and facilitating the easy boarding of the wheelchair and passenger's daily life;
- movable stretching crawlers are provided for increasing the distance between the fulcrum and the line of center of gravity of the wheelchair, whereby enhancing safety while going up and down the stairs;
- the movable stretching crawlers can rotate 360 degrees, and can be received at both sides of the body part to reduce the volume of the wheelchair, and to allow a safe passage when encountering an obstacle;
- the two-part design of the bottom of the body part allows a smooth and stable operation of the wheelchair while going up and down the stairs;
- the movable stretching crawlers are provided with an anti-reverse gear and a safety locking device to ensure that the crawlers could be locked in desired positions, whereby enhancing the safety thereof; and
- a compact type seat balance sensing device is provided, which is simple in structure and occupies a little space.

The above object and advantages of the present invention can be realized with the following features.

The electric wheelchair of the present invention comprises a movable seat part, a body part served as a support for the seat part, a seat adjustment mechanism arranged under the seat part for maintaining balance of the seat part, a bottom part arranged under the body part, and a crawler moving mechanism; wherein the crawler moving mechanism comprises two sets of crawlers arranged respectively at both sides underneath the bottom part, and each of which comprises a front crawler and a rear crawler.

The bottom part may be comprised of a front portion and a rear portion, which are movably connected with a coupling arrangement and capable of deflection in a specific range of angles with respect to each other.

The crawler moving mechanism may further comprise movable stretching crawlers arranged respectively at outside of the front crawler and fixed stair-climbing crawlers arranged respectively at outside of the rear crawler; wherein a pulley at one end of the movable stretching crawler is fixedly connected with a pulley at front end of the front crawler, and the free end of the movable stretching crawler can be rotated in forward or backward direction with respect to the fixed end of the movable stretching crawler within the range of 360° by means of a control lever; and a pulley at one end of the fixed stair-climbing crawler is fixedly connected with a pulley at rear end of the rear crawler, while the free end of the fixed stair-climbing crawler is inclined at a specific angle relative to the rear crawler.

The seat adjustment mechanism and the movable stretching crawlers might be respectively driven by an independent geared motor. Each set of the crawlers of the crawler moving mechanism might be respectively driven by a separate electric engine.

At both sides of bottom of the movable seat part a set of rollers can be respectively arranged, by which the movable seat part is supported on the body part, while each set of rollers can move along a sliding path formed on the body part by means of a control device, thereby driving the seat part to move.

The control device for controlling the rollers may comprise the control lever in electrical connection with the geared motor of the seat adjustment mechanism and a safety locking device arranged at the body part.

The safety locking device might be a dual wing safety locking device comprising a case, a pair of locking elements respectively mounted on a wall of the case and under the action of a spring, and two pinions of which one is configured as a small motor; wherein each of the locking elements has a portion with small gear teeth for respectively engaging with one of the pinions, and a portion with bull gear teeth for engaging with teeth of an arc-shaped bottom edge of a vertical plate of the seat portion while the safety locking device is in a locking state, when the safety locking device is in an unlocking state, the portion with bull gear teeth is driven by the small motor to disengage with the teeth of the arc-shaped bottom edge of the vertical plate of the seat portion and locked in its initial position by the respective springs.

The geared motor for driving the seat adjustment mechanism may comprise an anti-reverse helical gear.

The seat adjustment mechanism may comprise a balance sensing device comprising a heavy serving as a balance weight, and a support for supporting and allowing the swing of the heavy; wherein the support is equipped with a circuitry for electrical connection with the geared motor for the seat adjustment mechanism and a storage battery.

The geared motor for driving the seat adjustment mechanism may comprise an anti-reverse helical gear and a dual wing safety locking device.

The seat part may be connected with a gearwheel in the geared motor for driving the seat adjustment mechanism by means of a connecting device.

DETAILED DESCRIPTION OF THE PREFERRED EMBODIMENTS

Figure 1:
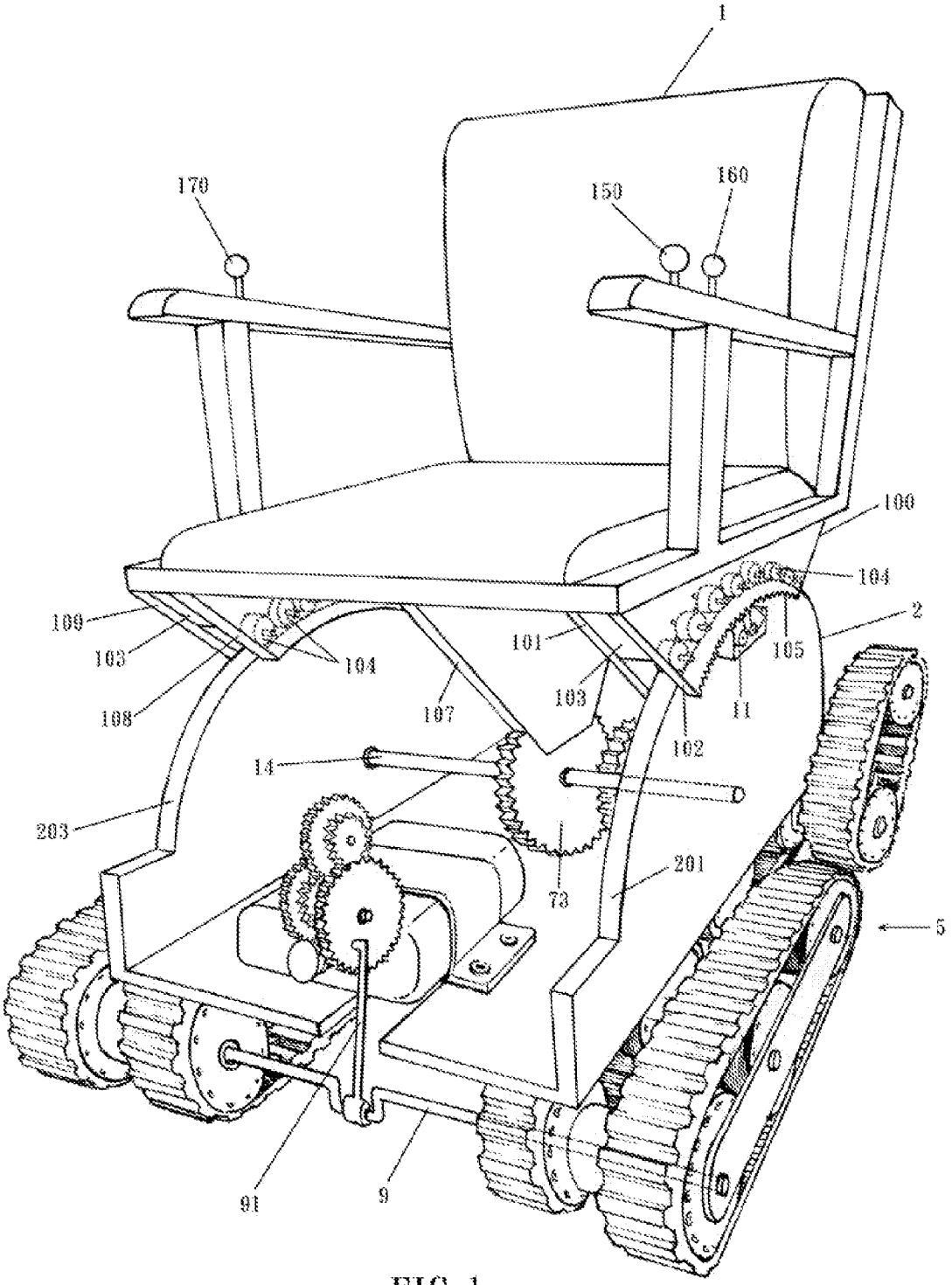
FIG. 1 is a perspective view of an embodiment of an electric wheelchair according to the present invention, which schematically shows a part of the components, wherein the movable stretching crawlers are arranged side by side with the front crawlers as in a storage location.

FIG. 1 is a perspective view of an embodiment of the electric wheelchair of the present invention, which schematically shows merely a part of the components for the clarity thereof. The electric wheelchair of the present invention comprises a seat part 1, a body part 2 served as a support for the seat part, a seat adjustment mechanism 3, a bottom part 4, and a crawler moving mechanism 5.

The seat part 1 comprises a seat and supporting components 100 fixedly mounted at opposite sides of the bottom of the seat. As those two supporting components are completely identical in their structure, only one of the supporting components will be described below.

Each supporting component 100 comprises two vertical plates 101, 102 (or 108, 109) being substantially perpendicular to the bottom of the seat, the top edge of the two vertical plates are spaced apart from each other and fixed to the bottom of the seat. The lower edge of the external vertical plate 102 is shaped to be a concaved curved toothed edge 105 (the lower edge of another external vertical plate 109 is not shown). A space 103 is defined between two vertical plates 101, 102 for receiving and mounting a plurality of rollers 104, while two ends of axle of each roller are respectively fixed on those two vertical plates.

The body part 2 served as the support for the seat comprises a base frame (or base plate) and two vertical lateral plates 201, 203 with same configuration, wherein the upper portion of each of the vertical lateral plates 201, 203 is shaped to be an arc-shaped portion. In this embodiment, the arc-shaped upper portion is sandwiched in between the spaced 103 defined by those two vertical plates 101, 102, 108, 109 of the supporting components of the seat part. A set of rollers 104 mounted between those two vertical plates 101, 102; 108, 109 of each supporting component is slidably supported on the arc-shaped top edge of the vertical lateral plates 201, 203, and the arc-shaped top edge serves as a sliding path of the rollers 104. A safety locking device 11 (only one is shown) is mounted on a lateral wall of each lateral plates 201, 203, and the safety locking device 11 will cooperate with the concaved curved toothed edge of the external vertical plate of the supporting component of the seat, which will be described in detail below.

Figure 2:
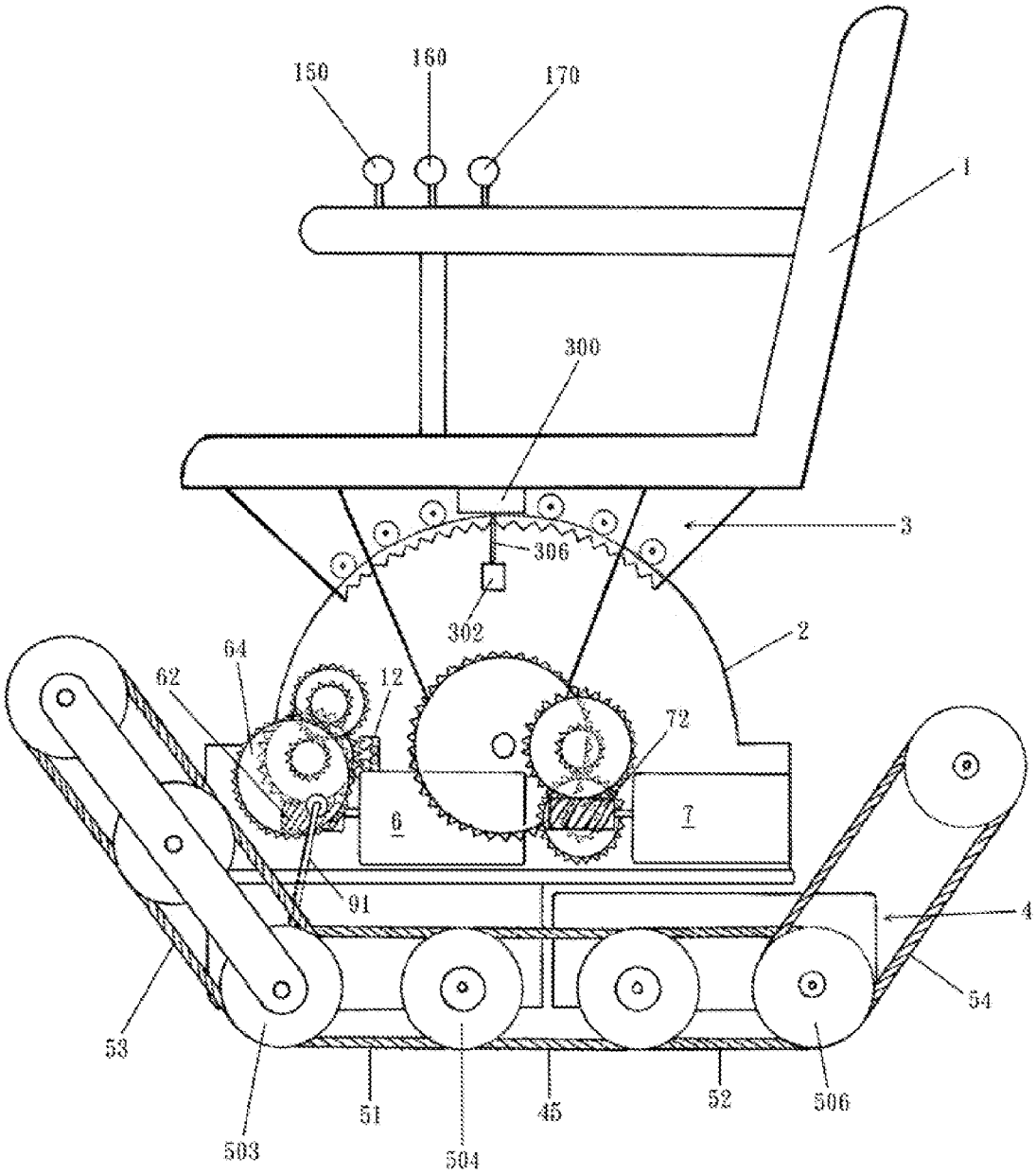
FIG. 2 is a part sectioned schematic view of the wheelchair show in FIG. 1, wherein the movable stretching crawlers are forwardly rotated to a position with a specific angle.

A geared motor 6 for controlling the movable stretching crawlers and a geared motor 7 for controlling the seat adjustment mechanism 3 are arranged on the base frame of the body part 2, as shown in FIG. 2.

The gear set of the geared motor 7 of the seat adjustment mechanism comprises a bull gear 73; on the one hand, the bull gear 73 is fixedly connected with the seat part via a connecting device 107 (see FIG. 1); on the other hand, the bull gear 73 is movably connected with those two vertical lateral plates 201, 203 of the body part 2 via a rod 14 passing through its center hole, wherein two ends of the rod 14 are respectively fixed to the center position of the arc-shaped portion of the vertical lateral plates 201, 203, and the bull gear 73 can pivot about the rod 14.

The components used for driving the crawlers are preferably arranged in the bottom part 4 underneath the body part 2.

The crawler moving mechanism 5 comprises two set of crawlers arranged under both sides of the bottom part 4. Each set of crawlers comprises a front crawler 51, a rear crawler 52, a movable stretching crawler 53 arranged outside the front crawler 51, and a fixed stair-climbing crawler 54 arranged outside the rear crawler 52. The front crawler 51 and the rear crawler 52 are movably connected with a coupling arrangement 45 (e.g. another crawler). A pulley 506 at one end of the fixed stair-climbing crawler 54 is fixedly connected side by side with a driving pulley at rear end of the rear crawler 52, and another end of the fixed stair-climbing crawler is inclined at a specific angle relative to the rear crawler (see FIG. 2). A pulley 503 at one end of the movable stretching crawler 53 is fixedly connected side by side with a pulley at front end of the front crawler 51, and a free end of the movable stretching crawler 53 could be rotated 360° about the pulley 503 of its fixed end in forward or backward direction. The pulley 503 at respective fixed ends of the two movable stretching crawlers are connected by a shaft lever 9, which passes freely through the center holes of two pulleys of respective front ends of the front crawlers, and the shaft lever 9 is in eccentric connection with the bull gear 64 of the gear set of the geared motor 6 for controlling the movable stretching crawler by means of a connecting rod 91 located at the mid position of the shaft lever.

Referring to FIGS. 2, 3*a*, 3*b* and 10, the bottom part 4 is comprised of a front portion 41 and a rear portion 42 arranged side by side, which are connected together by the coupling arrangement 45 and capable of deflection in a specific range of angles with respect to each other. In this embodiment, the coupling arrangement 45 is a crawler, wherein the crawler 45 interconnects the front portion and the rear portion by means of the pulley at rear end of the front crawler 51 and the pulley at front end of the rear crawler 52, Definitely, the coupling arrangement 45 is not limited to the foregoing crawler, which could be any other device known in the art, for example, a chain, or the like.

Figure 3A:
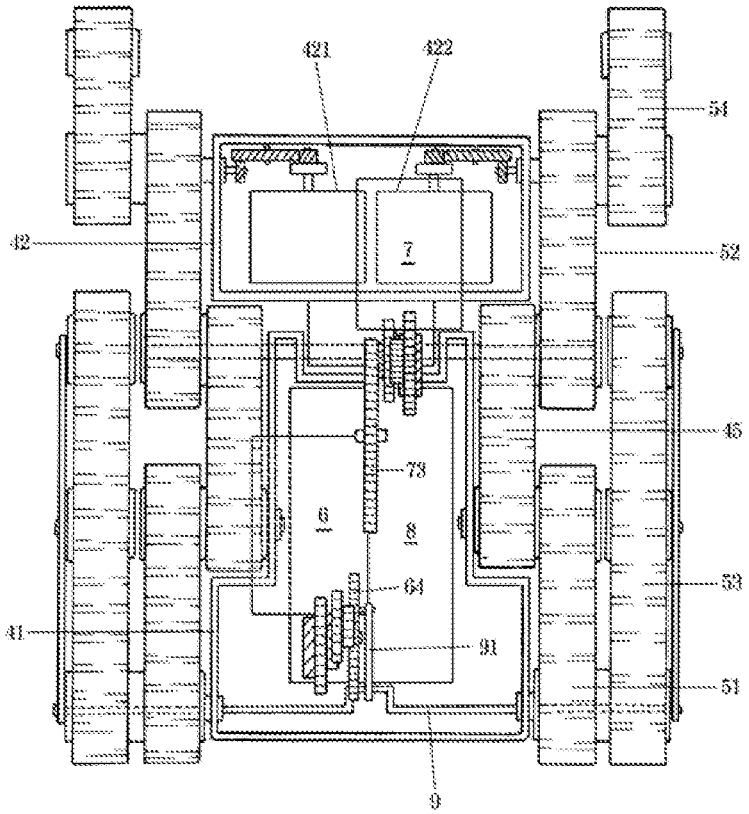
FIG. 3*a* is a plan view of one embodiment of the electric wheelchair as shown in FIG. 1, which shows the body part and several driving components located therein, wherein an electric engine is arranged in the rear portion of the body part.

Referring to FIG. 3*a*, a storage battery 8 for powering respective driving devices is arranged in the front portion 41, and two separate electric engines 421, 422 are arranged in the rear portion 42 and used for driving a respective set of crawlers, whereby enabling the crawler set to move forward or backward, and turn left or right for 360° steering. These two electric engines 421, 422 are controlled by a control lever 170 arranged at the armrest of the seat. In this embodiment, the electric engine 421. 422 directly drive the pulley 506 at rear end of the rear crawler 52, and drive the front crawler 51 by the coupling arrangement 45. As the pulley 503 at one end of the movable stretching crawlers 53 is fixedly connected with the pulley at front end of the front crawler 51, the power of the electric engines could thus be transferred to the movable stretching crawlers and make it move.

Figure 3B:
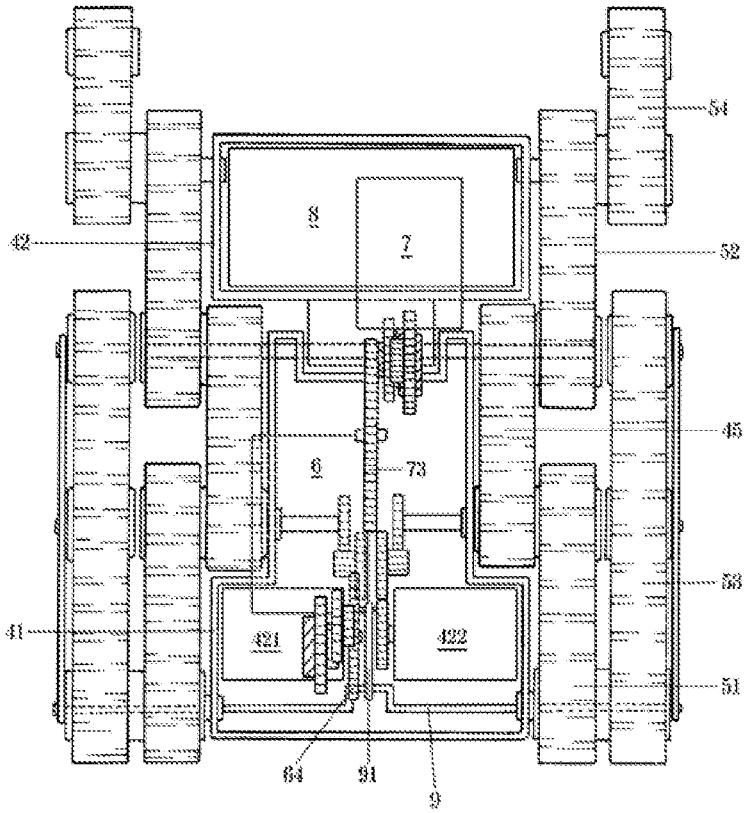
FIG. 3*b* is a plan view of another embodiment of the electric wheelchair as shown in FIG. 1, which shows the body part and several driving components located therein, wherein an electric engine is arranged in the front portion of the body part.

In another embodiment, as shown in FIG. 3*b*, the storage battery 8 for powering respective driving devices is arranged in the rear portion 42, and two separate electric engines 421, 422 are arranged in the front portion 41 and used for driving a respective set of crawlers, whereby enabling the crawler set to move forward or backward, and turn left or right for 360° steering. These two electric engines 421, 422 are controlled by the control lever 170 arranged at the armrest of the seat. In this embodiment, the electric engine 421. 422 directly drive the coupling arrangement 45 and the pulley 504 at rear end of the front crawler 51, and drive the rear crawler 52 to move through the coupling arrangement 45, and then drive the fixed stair-climbing crawlers 54 through the pulley 506 at rear end of the rear crawler 52.

Figure 4:
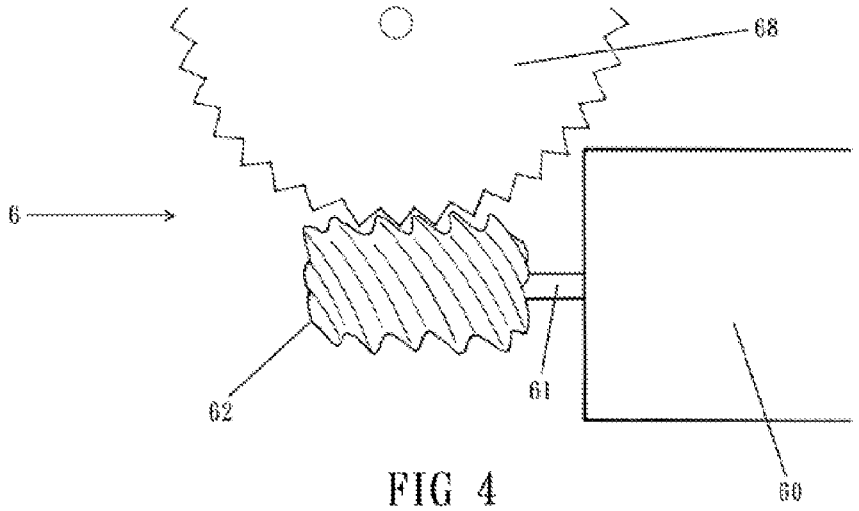
FIG. 4 is a schematic view of an anti-reverse gear combination.

The geared motor 6 for controlling the movable stretching crawlers drives the movable stretching crawlers 53 via the shaft lever 9, which allows the free end of the movable stretching crawlers 53 to rotate to any angle and jib relative to its fixed end, this is implemented by the anti-reverse helical gear 62 in the gear set of the geared motor 6. Referring to FIG. 4, the anti-reverse helical gear 62 is directly driven by the motor 60 of the geared motor 6 via a shaft 61, and it engages with a gear 68 in the gear set of the geared motor 6. When the motor is energized to operate, the anti-reverse helical gear 62 drives the gear 68 and thus the movable stretching crawlers 53 to rotate; when the motor is disengaged and stop running, the anti-reverse helical gear 62 will also stop, and the movable stretching crawlers 53 will be locked in the desired position as the gear 68 can not drive the anti-reverse helical gear 62 to move. The geared motor is controlled by a control lever 160 arranged at the armrest of the seat.

Similarly, the gear set of the geared motor 7 for controlling the seat adjustment mechanism 3 also comprises an anti-reverse helical gear 72, as shown in FIG. 2. When the geared motor 7 is energized to operate, the helical gear 72 drives the gear set to rotate, wherein the bull gear 73 fixedly connected with the seat will drive the seat part 1 to move forward or backward along the sliding path at the upper edge of the vertical lateral plates 201, 203 of the body part 2; when the motor stops running, the seat will be locked at the appropriate position as the gear set can not drive the helical gear.

Figure 5A:
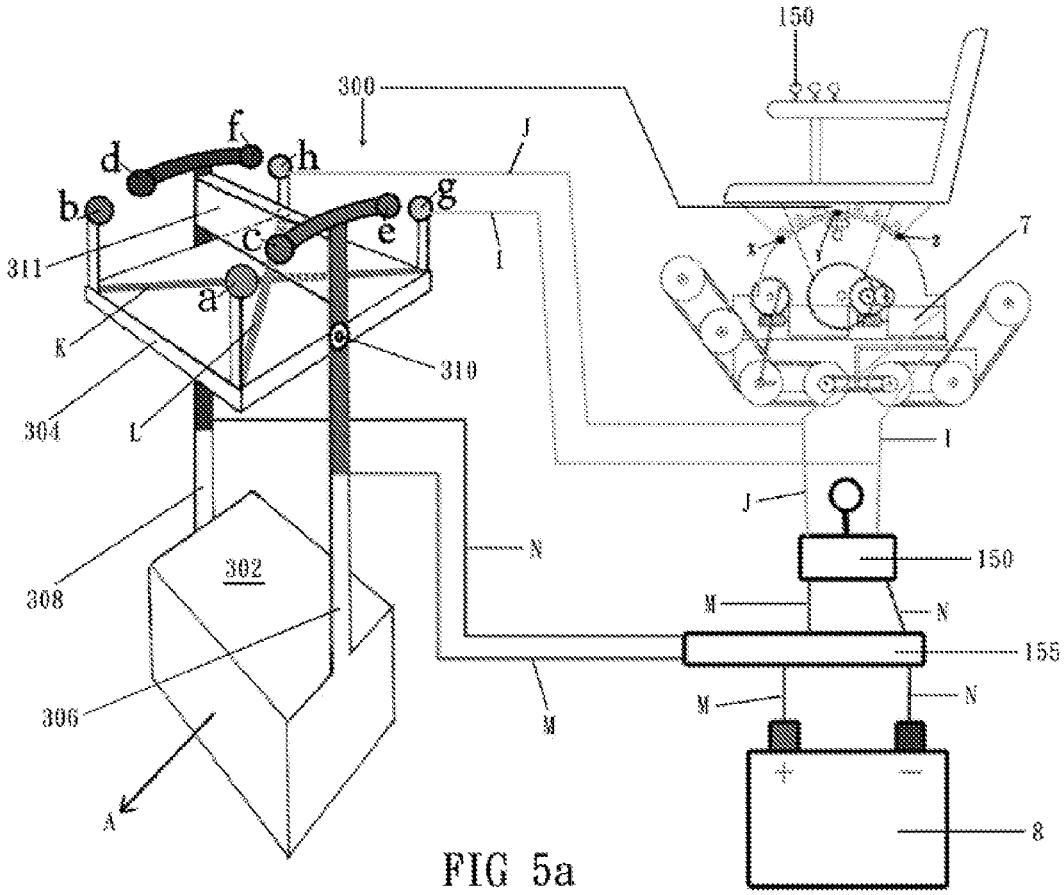
FIG. 5*a* is an operation design diagram of the seat adjustment mechanism of an electric wheelchair according to the present invention.

Referring to FIG. 5*a*, the seat adjustment mechanism 3 includes a balance sensing device 300 arranged at the bottom of the seat. In one embodiment, the balance sensing device 300 includes a heavy 302 and a support 304 for bearing the heavy 302 and equipping a circuitry. The balance sensing device 300 can be mounted at the bottom of the seat in a normal and hanging manner. In one embodiment, it is mounted between two internal vertical plates 101, 108 at the bottom of the seat, and it is adjacent to one of the internal vertical plates 101 or 108.

The heavy 302 is movably connected with the support 304 by two connecting rods 306, 308 arranged at opposite sides thereof, while the connection point 310 of the support 304 and each of connecting rods 306, 308 serves as a fulcrum, whereby making the heavy 302 serving as a balance weight to swing around the fulcrums in a forward direction (direction pointed by arrow A in the figure, namely the facing direction of the passenger) or a backward direction. In this embodiment, the two connecting rods 306, 308 are basically in a "T" shape, the free end of one of the connecting rods 306 is provided with two opposite anode contacts c and e, and the free end of another connecting rod 308 is provided with two opposite cathode contacts d and f. Contacts a and g corresponding to the anode contacts c and e of the connecting rod 306 are provided on a lateral edge of the support 304 at the same side as the connecting rod 306, while contacts b and h corresponding to the cathode contacts d and f of the connecting rod 308 are provided on a lateral edge of the support 304 at the same side as the connecting rod 308; wherein two contacts a and h on the support 304 are connected through the wire L, while the other two contacts b and g are connected by wire K. The contacts g and h are respectively in electrical connection with the geared motor 7 for controlling the seat adjustment mechanism through the wires I and J, while the connecting rods 306, 308 are respectively in electrical connection with an automatic/manual mode change-over switch 155 through wires M and N. The automatic/manual mode change-over switch 155 can be arranged at the armrest of the seat or other locations to facilitate the use of passenger, and it is in electrical connection with, on the one hand, the storage battery mounted in the bottom part, and, on the other hand, a control lever 150 arranged on the armrest of the geared motor 7 for controlling the seat adjustment mechanism 3, whereby switching the modes of operation of the seat adjustment mechanism 3 through the automatic/manual mode change-over switch 155.

When the automatic mode is activated, the balance sensing device 300 at the bottom of the seat is powered up. In the case of going up or down the stairs, the passenger or the wheelchair must back on to the stairs, the wheelchair will be inclined while going up the stairs (i.e. the rear part has been elevated), the heavy 302 of the balance sensing device 300 will swing forward, such that the anode contact e of the connecting rod 306 makes contact with the contact g of the support 304; while the cathode contact f of the connecting rod 308 will make contact with the contact h of the support 304 to establish an electrical connection. At this point, the current will flow through contacts g and h to activate the geared motor 7 of the seat adjustment mechanism, such that the seat will rotate from point Y to point Z and always maintain a balance with the ground. On the contrary, when the electric wheelchair going up a ramp, the heavy 302 will swing backward, and the anode contact c of the connecting rod 306 will make contact with the contact a of the support 304, and connect with the contact h of the support 304 through the wire L; while the cathode contact d of the connecting rod 308 will make contact with the contact b of the support 304, and connect with the contact g of the support 304 through the wire K. Finally, the current will flow through the contacts g and h of reversed polarity to activate the geared motor 7 for reverse operation, so that the seat will rotate from point Y to point X and always maintain a balance with the ground. When going up or down a slope, the passenger or the electric wheelchair can selectively face or back on to the slope. In latter case, the situation will be similar to the foregoing, or the situation will be opposite if the passenger or the electric wheelchair is selected to face the slope.

Figure 5B:
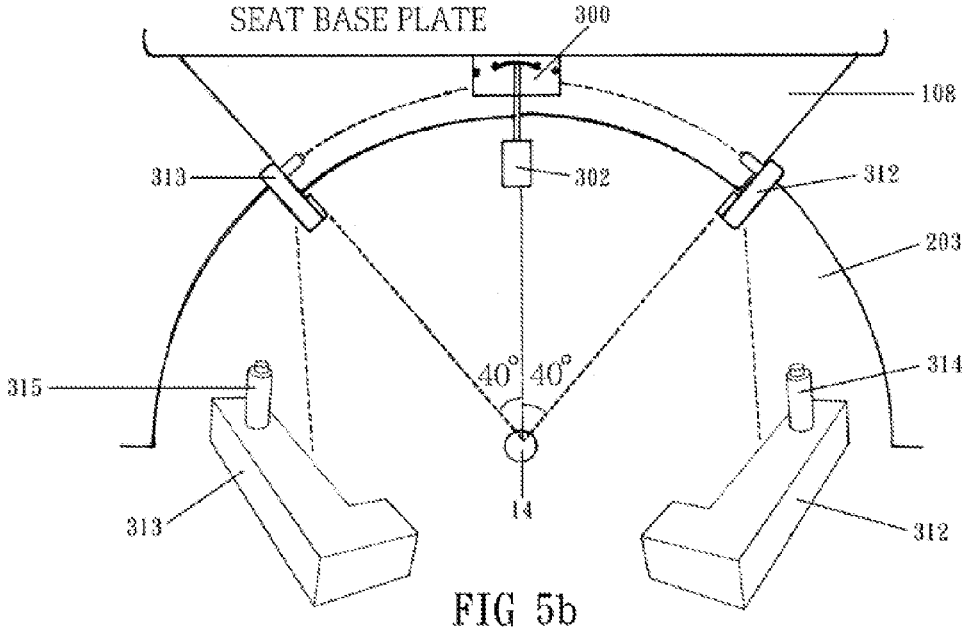
FIG. 5*b* is a schematic view of the balance sensing device, in its initial position, of the seat adjusting mechanism according to the present invention, which only shows the configuration of a vertical plate of the seat support and a vertical lateral plate at right side of the wheelchair as shown in FIG. 2.
Figure 5C:
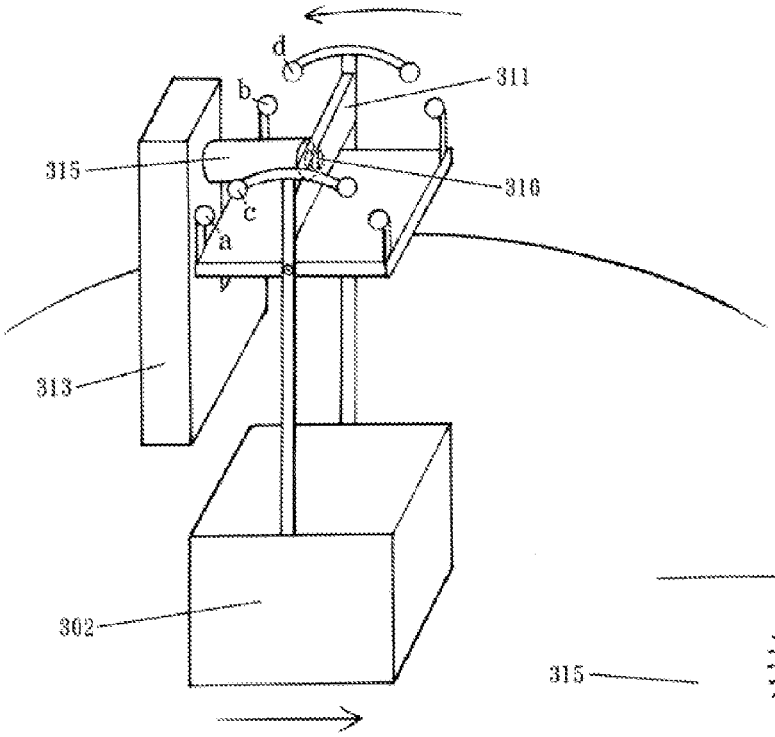
FIG. 5*c* is a schematic view showing the operation of the balance sensing device of FIG. 5*b*, which has reached the end position of one end.
Figure 5D:
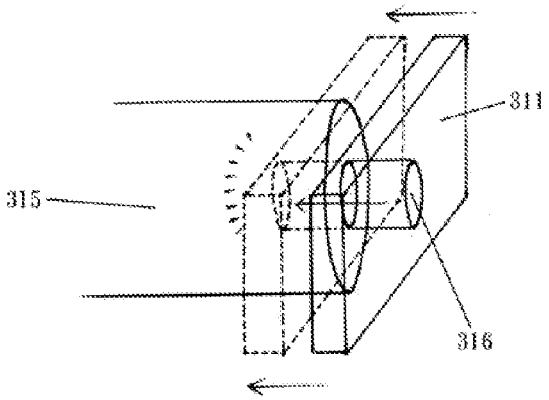
FIG. 5*d* is a schematic view of the balance sensing device of FIG. 5*b*, wherein its insulation plate is in contact with a sensing button of a rod-shaped piece of a blocking device located at the end position of one end.

Referring FIGS. 5*b* to 5*d*, according to one embodiment, an insulation plate 311 (see FIG. 5*c*) could be arranged between those two connecting rods 306 and 308 above the support 304 in order to ensure the safety and reliability of the motion of the seat part, wherein two sides of the insulation plate could be respectively fixed on the connecting rods 306 and 308. In addition, the internal wall of one of the vertical lateral plates 201 of the body part 2 could be provided with two induction blocking device 312, 313 roughly in the form of "L", and those two blocking devices are located in the path of motion of the balance sensing device 300, so as to limit the range of movement of the seat part. As the motion path of the balance sensing device 300 is on a circular arc having the fixed end point of the rod 14 as the center. Therefore, in this embodiment, the forward or backward movement of the seat part is limited to the range of 40 degrees, for example.

For this end, those two blocking devices 312, 313 might be respectively arranged at the end points of the path of motion of the balance sensing device 300, such that they are respectively forming an angle of 40 degrees in radial direction with the balance sensing device 300. It should be noted that it is apparent to a person skilled in the art that the angle could be set to a smaller or larger one, so as to accommodate stairs with different inclination, wherein the inclination for most of the stair cases is in the range of 20-35 degrees.

The lower part of each blocking device is fixed on the inner wall of the vertical lateral plates 201, 203, while its upper part is spaced part from the inner wall of the vertical lateral plates 201, 203, whereby allowing the internal vertical plates 101, 108 of the supporting components 100 of the seat part could pass through freely between the blocking devices and the inner walls of the vertical lateral plates 201, 203. The opposite sides of those two blocking device 312, 313 are respectively further provided with a rod-shaped piece 314, 315. The rod-shaped piece extends substantially perpendicular to the upper part of the body of the blocking device, and a sensing button 316 serving as an alarm switch is arranged at the end remote from the body of the blocking device. The sensing button 316 is configured to resiliently retract into the interior of the rod-shaped piece while being compressed, and it is also in electrical connection with an alarm arranged on the wheelchair (not shown), wherein the alarm can be arranged at any suitable location of the body part of the wheelchair. When the respective sensing button 316 is in the release state, the total axial length of the rod-shaped piece 314, 315 is greater than the distance between the body of the rod-shaped piece in contact with the balance sensing device 300 and the insulation plate 311 of the balance sensing device 300, such that the sensing button could make contact with the insulation plate 311 and could be pressed and retracted into the interior of the rod-shaped piece to activate the alarm.

Figure 6A:
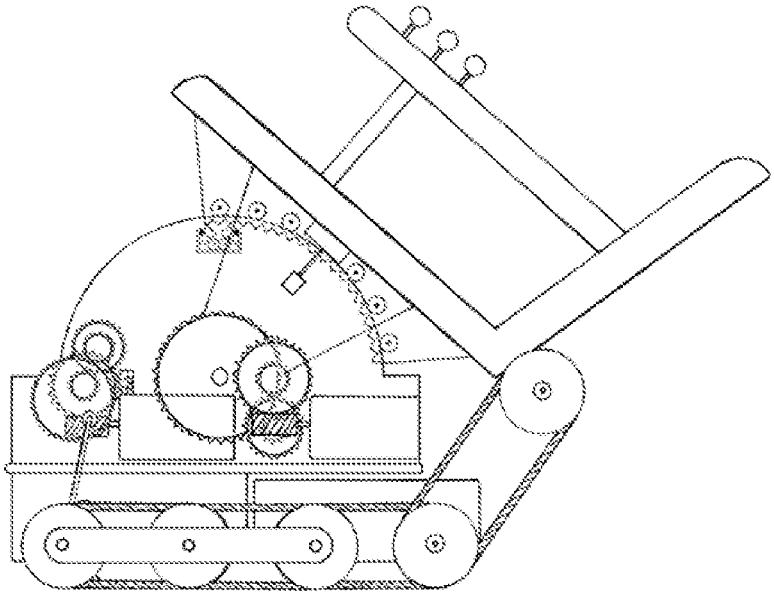
FIGS. 6*a* and 6*b* are schematic views of two adjustment modes of the seat part.
Figure 6B:
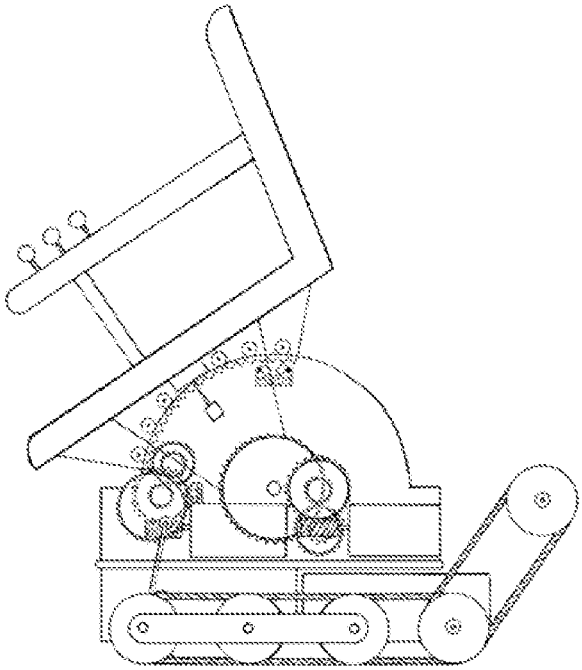

When going up or down a slope with a relatively large inclination and taking the case of facing and going up the slope as an example, the balance sensing device 300 in this embodiment is arranged between the internal vertical plate 108 of the supporting component 100 at the right of the seat part (i.e., the right-hand side of the passenger) and the base plate of the seat, as shown in FIG. 5*b*. When the body of the wheelchair is inclined (i.e., the front part of the body is elevated) for climbing up the slope, the heavy 302 will swing backward due to the gravity force, such that the contacts a, b of the balance sensing device 300 make contact with contacts c, d to activate the geared motor 7 to effect reverse rotation, whereby making the seat moves from point Y to point X, as shown in FIG. 5*a*. When the body of the wheelchair is inclined to an angle of to 40 degrees, the balance sensing device 300 will move with the seat and contact with the blocking device 313, as shown in FIGS. 5*c* and 5*d*. At this point, the sensing button 316 of the rod-shaped piece 315 of the sensing balance device 300 will be pressed by the insulation plate 311 and retracted into the interior of the rod-shaped piece 315 to activate the alarm, which generates an alarm tone to remind the passenger that the maximum inclination of the wheelchair body is reached and stop moving further. On the other hand, as the rod-shaped piece 315 of the blocking device 313 presses against the insulation plate 311 of the balance sensing device 300, the connecting rods 306, 308 of the heavy of the balance sensing device 300 will remain in their initial positions, that is, the connecting rods 306, 308 are in the positions being perpendicular to the support 304 and without deflection, such that their contacts can not make contact with the corresponding contacts on the support 304, whereby making the seat can not slide forward or backward. In this case, when the wheelchair is returning to the level ground, the seat will always maintain its balance state until reach safely the level ground by the regulation of the balancing sensor device 300. When the manual mode is activated, the power to the balance sensing device 300 will be cut via a switch, and the wheelchair could be controlled by the control lever 150 of the geared motor 7. Under this mode, the passenger could rotate voluntarily the seat from point Y to point Z, or from point Y to point X, by means of the control lever 150, thereby increasing the flexibility thereof, and the passenger could get on and off the wheelchair in a more convenient way. For example, as shown in FIGS. 6*a* and 6*b*, the seat could be moved to the rear for facilitating hair washing of the passenger, or facilitating a easy transfer to a seat or a bed from the rear. When the seat is adjusted and moved to the front, the passengers can remove all alone to a car, a seat or a bed, or the like, even without the assistance from the others.

Figure 7A:
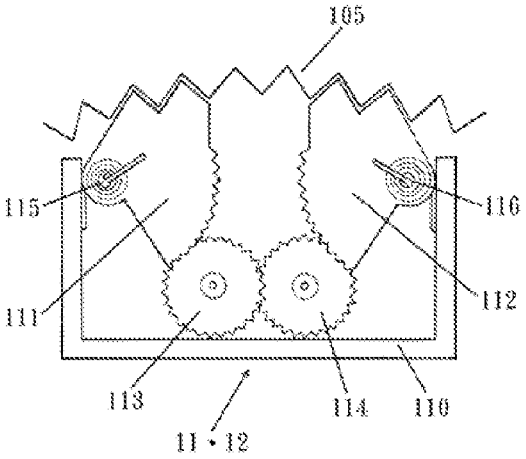
FIG. 7*a* is a schematic structural diagram of the dual wing safety locking device in the locking state.
Figure 7B:
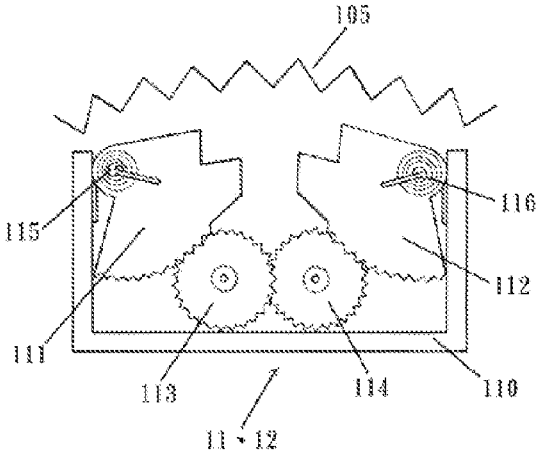
FIG. 7*b* is a schematic structural diagram of the dual wing safety locking device in the unlocking state.
Figure 8:
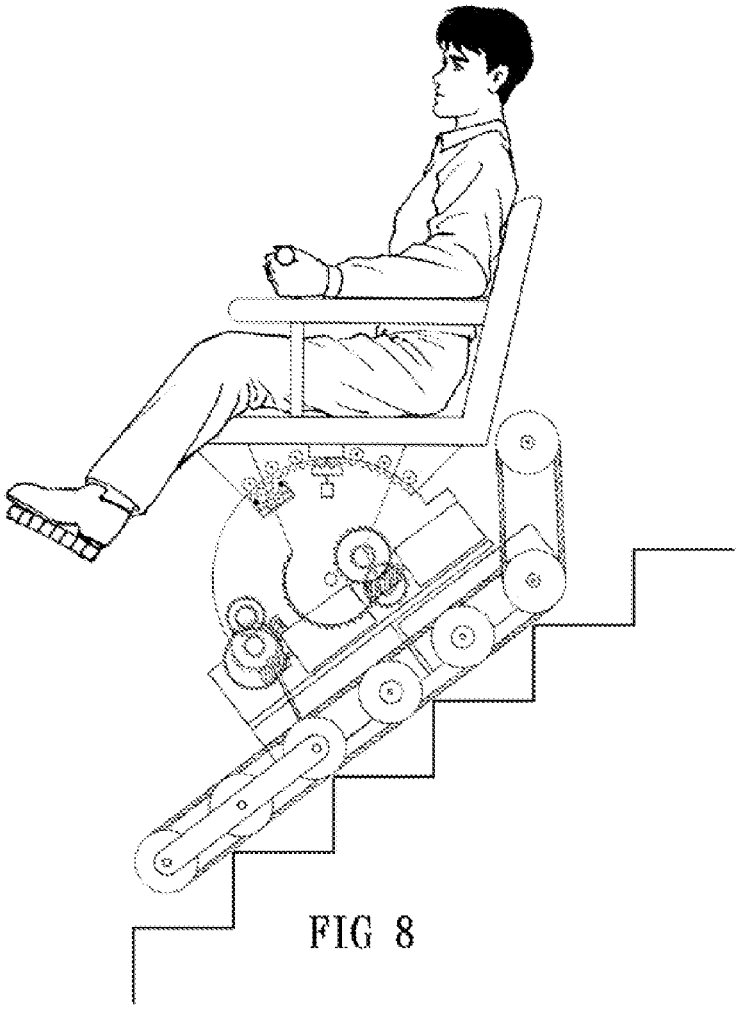
FIG. 8 is a schematic view showing the position and status of the movable stretching crawlers of the electric wheelchair of the present invention while going up and down the stairs.
Figure 9:
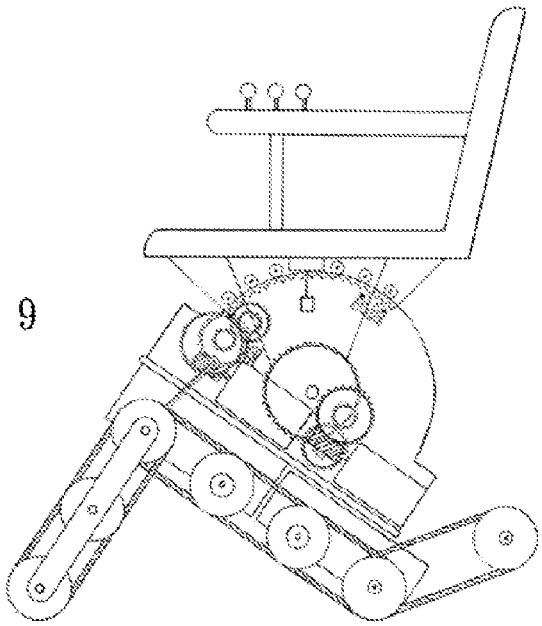
FIG. 9 is a schematic view of the elevated state of the seat of the electric wheelchair according to the present invention.

The seat adjustment mechanism 3 also includes a safety locking device 11 arranged on lateral walls of each of vertical lateral plates 201, 203 of the body part 2 and being able to engage with the teeth 105 of the arc-shaped bottom edge of the external vertical plates 102, 109 of the seat part. The safety locking device 11 might be a dual wing safety locking device as shown in FIGS. 7*a* and 7*b*, which comprises a case 110, a pair of locking elements 111, 112 respectively mounted on a wall of the case and under the action of a spring 115, 116, and two pinions 113, 114 of which one pinion 114 is configured as a small motor. Each of the locking elements has a portion with small gear teeth for respectively engaging with one of the pinions 113, 114, and a portion with bull gear teeth for engaging with teeth 105 of the arc-shaped bottom of the external vertical plates 102, 109 while the safety locking device is in a locking state. When the safety locking device is in an unlocking state, the portion with bull gear teeth is driven by the small motor to disengage with the teeth 105 of the arc-shaped bottom edge of the vertical plate 102, 109 and locked in its initial position by the respective springs 115, 116. When the safety locking device is in use, the power of the small motor 114 is directly connected with the motor of the geared motor 7 of the seat adjustment mechanism 3. When the wheelchair moves stably, the swing of the heavy 302 of the balanced sensing device 300 is insufficient to activate the power of the balance sensing device, such that the motor of the geared motor 7 and the small motor 114 of the safety locking device could not be powered up and activated. Therefore, the left and right locking elements of the safety locking device will lock up the wheelchair under the action of the springs. When the wheelchair is inclined, the balance sensing device will simultaneously activate the motor of the geared motor 7 and the small motor 114 of the safety locking device. The small motor is rotated clockwisely, whereby the locking element engaged with the small motor will be rotated counterclockwisely and disengaged with the teeth 105 of the arc-shaped bottom edge of the vertical plates 102, 109; while the small motor will also drive another pinion to rotate counterclockwisely, whereby another locking element will be disengaged with the teeth 105 of the arc-shaped bottom edge of the vertical plates 102, 109, so that the movable seat part could be slid smoothly.

As there are two locking elements, no matter which direction the wheelchair is inclined to, such as the case of running the manual mode as shown in FIGS. 6*a* and 6*b*, the wheelchair could be locked up firmly by the locking elements and will not be tipped over.

The foregoing dual wing type safety locking device is merely a preferred embodiment of the present invention, it is apparent to a person skilled in the art that any other devices capable of realizing the locking function can be also employed.

In the aspect of controlling the movable stretching crawlers, a foregoing dual wing type safety locking device 12 might be preferably arranged in the gear set of the geared motor 6 for controlling the movable stretching crawlers, as shown in FIG. 2. In this way, when the geared motor 6 is energized, the safety locking device 12 will be automatically powered up and unlocked, whereby allowing the gear set of the geared motor 6 to drive the movable stretching crawlers 53 to rotate to the desired position. When the motor stops running, the safety locking device will lock up the gear set, whereby the movable stretching crawlers 53 could not rotate and thus stay in the desired position.

As the electric wheelchair of the present invention employs the anti-reverse helical gear and dual wing type safety locking device, in any cases, the movable seat and the movable stretching crawlers of the wheelchair could maintain their stability, whereby the safety of passenger could be ensured.

In addition, due to the fact that the electric wheelchair of the present invention employs the movable stretching crawlers capable of 360° rotation, when necessary, the movable stretching crawlers can be rotated upward and forward until the free end of the stretching crawlers reaches the level ground to make the front part of the wheelchair elevated. Further, the movable seat could be automatically adjusted by the seat adjustment mechanism of the present invention to achieve a vertical equilibrium state, in which the passenger might have a visual field as a standing person. When the electric wheelchair in motion encounters an obstacle, the movable stretching crawlers could be rotated backward and downward until the free end of the stretching crawlers touch and is supported by the level ground, to allow the front end of the body of the wheelchair to be elevated to a height for climbing over the obstacle, whereby the wheelchair could be passed safely.

Figure 10:
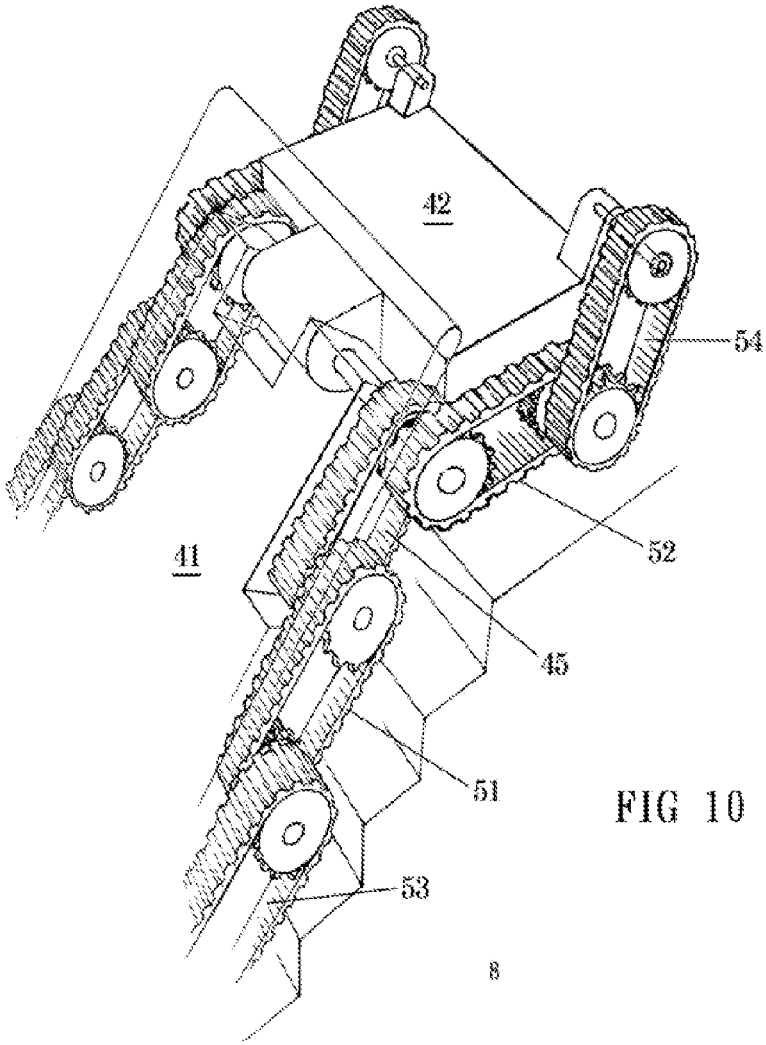
FIG. 10 is a schematic view showing the electric wheelchair of the present invention being climbed to the top of the stair case, where the front and rear portions formed the bottom of the vehicle are deflected into a specific angle with respect to each other, whereby making the rear portion to land the top of the stair case first.

When the electric wheelchair of the present invention is used for going up a stair case, the passenger could firstly steer the wheelchair with his back towards the stair case, and control the control lever 170 for controlling the motion of crawlers with one hand to make the wheelchair move slowly and backwardly until the fixed stair-climbing crawlers make contact with the stairs, and then the wheelchair is driven going up the stairs with use of the back crawlers; and control the control lever 160 for controlling the movable stretching crawlers with another hand to make the stretching crawlers rotate forwardly from both sides of the body of the wheelchair, such that the front and rear crawlers are aligned. Since the body of the wheelchair will be inclined while going up the stairs, the seat adjustment mechanism will play its role to maintain the balance of the passenger. When the wheelchair reach the top of the stair case, the rear part of the body of the wheelchair will touch the level ground first while the front crawlers are still remained on the stairs, and then the rear crawlers will be deflected relative to the front crawlers in a specific angle, as shown in FIG. 10, such that the rear crawlers could safely land the level ground without making a sudden drop of the body of the wheelchair and bringing a impact to the passenger. When the wheelchair completely reaches the level ground, the front and rear crawlers will be aligned again and the stretching crawler could be retracted backwardly and received at both sides of the body part to reduce the length of the wheelchair.

When going down a stair case, the passenger could firstly drive the wheelchair carefully to the edge of the stairs, and control the control lever 160 for controlling the movable stretching crawlers to make the stretching crawlers to extend forwardly from both sides until their front end make contact with the stairs, and then slowly drive the wheelchair forward and make use of the stretching crawlers to maintain the stability of the wheelchair. When the wheelchair is inclined while going down the stairs, the seat adjustment mechanism will play its role to maintain the balance of the passenger. When the wheelchair reaches the level ground, the front end of the movable stretching crawlers will land the level ground first, and then the passenger could control the stretching crawlers to make it slowly retract for a smooth landing of the wheelchair.

When the passenger gets on the wheelchair, the balance sensing device could be turned off so as to switch the seat adjustment mechanism from the automatic mode to the manual mode, and the inclination of the seat part could be adjusted via the control lever 150, when an appropriate inclination is reached, the anti-reverse gear set and the safety locking device will lock up the wheelchair at the desired angular position, so that the passenger could be safely removed from the wheelchair to beds, seats, toilets, or the like, and vice versa.

The foregoing control levers and switching devices could be arranged at one side or both sides of the armrest of the wheelchair, any other locations for facilitating the manipulation of the passenger.

While the advantages and preferred embodiments of the present invention have been described hereinbefore, those skilled in the art should be understood that the above are merely several illustrative embodiments of the present invention without limiting the scope thereof, wherein various modifications, alterations or substitutions may be made to the specific components of the embodiments without departing from the spirit and scope of the invention and its claims.

What is claimed is:

1. An electric wheelchair, comprising:

a movable seat part fixedly connected with a bull gear in a geared motor;

a body part serving as a support for the seat part;

a seat adjustment mechanism arranged under the seat part for maintaining balance of the seat part, the bull gear driving the seat adjustment mechanism by means of a connecting device;

a bottom part arranged under the body part, and being comprised of a front portion and a rear portion, which are movably connected with a coupling arrangement and capable of deflection in a specific range of angles with respect to each other;

a crawler moving mechanism comprising two sets of crawlers arranged respectively at sides underneath the bottom part, the set of crawlers comprising:

a front crawler;

a rear crawler;

a movable stretching crawler arranged at an outside of the front crawler; and a fixed stair-climbing crawler arranged at an outside of the rear crawler; wherein a pulley at one end of the movable stretching crawler is fixedly connected with a pulley at a front end of the front crawler, and a free end of the movable stretching crawler is rotatable in forward or backward directions with respect to a fixed end of the movable stretching crawler within the range of 360° by means of a control lever; and wherein a pulley at one end of the fixed stair-climbing crawler is fixedly connected with a pulley at a rear end of the rear crawler, while a free end of the fixed stair-climbing crawler is inclined at a specific angle relative to the rear crawler; and components for driving the set of crawlers arranged in the bottom part.

2. An electric wheelchair of claim 1, wherein the moveable stretching crawlers are driven by a second geared motor.

3. An electric wheelchair of claim 2, wherein the geared motor for driving the seat adjustment mechanism comprises an anti-reverse helical gear.

4. An electric wheelchair of claim 1, wherein the set of the crawlers of the crawler moving mechanism is respectively driven by a separate electric engine.

5. An electric wheelchair of claim 1, wherein at both sides of bottom of the movable seat part a set of rollers is respectively arranged, by which the movable seat part is supported on the body part, while the set of rollers moves along a sliding path formed on the body part by means of a control device, thereby driving the seat part to move.

6. An electric wheelchair of claim 5, wherein the control device for controlling the set of rollers comprises a further control lever in electrical connection with a second geared motor of the seat adjustment mechanism and a safety locking device arranged at the body part.

7. An electric wheelchair of claim 6, wherein the safety locking device is a dual wing safety locking device comprising a case, a pair of locking elements respectively mounted on a wall of the case and under an action of a spring, and two pinions of which one is configured as a small motor; wherein each of the locking elements has a portion with small gear teeth for respectively engaging with one of the pinions, and a portion with bull gear teeth for engaging with teeth of an arc-shaped bottom edge of a vertical plate of the seat portion while the safety locking device is in a locking state, when the safety locking device is in an unlocking state, the portion with bull gear teeth is driven by the small motor to disengage with the teeth of the arc-shaped bottom edge of the vertical plate of the seat portion and locked in an initial position by the respective springs.

8. An electric wheelchair of claim 6, wherein the geared motor for driving the seat adjustment mechanism comprises an anti-reverse helical gear.

9. An electric wheelchair of claim 6, wherein the geared motor for driving the seat adjustment mechanism comprises an anti-reverse helical gear and a dual wing safety locking device.

10. An electric wheelchair of claim 1, wherein the components for driving the set of crawlers include a storage battery, and a driving device powered by the storage battery.

11. An electric wheelchair of claim 10, wherein the driving device comprises at least one electric engine.

12. An electric wheelchair, comprising:

a movable seat part;

a body part serving as a support for the seat part;

a seat adjustment mechanism arranged under the seat part for maintaining balance of the seat part, the seat adjustment mechanism includes a balance sensing device comprising a balance weight, and a support for supporting and allowing a swing of the balance weight; the support being equipped with a circuitry for electrical connection with a geared motor for the seat adjustment mechanism and for electrical connection with a storage battery;

a bottom part arranged under the body part, and being comprised of a front portion and a rear portion, which are movably connected with a coupling arrangement and capable of deflection in a specific range of angles with respect to each other;

a crawler moving mechanism comprising two sets of crawlers arranged respectively at sides underneath the bottom part, the set of crawlers comprising:

a front crawler;

a rear crawler;

a movable stretching crawler arranged at an outside of the front crawler; and a fixed stair-climbing crawler arranged at an outside of the rear crawler; wherein a pulley at one end of the movable stretching crawler is fixedly connected with a pulley at a front end of the front crawler, and a free end of the movable stretching crawler is rotatable in forward or backward directions with respect to a fixed end of the movable stretching crawler within the range of 360° by means of a control lever; and wherein a pulley at one end of the fixed stair-climbing crawler is fixedly connected with a pulley at a rear end of the rear crawler, while a free end of the fixed stair-climbing crawler is inclined at a specific angle relative to the rear crawler; and components for driving the set of crawlers arranged in the bottom part.

13. An electric wheelchair, comprising:

a movable seat part;

a body part serving as a support for the seat part;

a seat adjustment mechanism arranged under the seat part for maintaining balance of the seat part and being driven by a first geared motor, the first geared motor for driving the seat adjustment mechanism comprising an anti-reverse helical gear and a dual wing safety locking device;

a bottom part arranged under the body part, and being comprised of a front portion and a rear portion, which are movably connected with a coupling arrangement and capable of deflection in a specific range of angles with respect to each other;

a crawler moving mechanism driven by a second geared motor that is independent of the first geared motor, said crawler mechanism comprising two sets of crawlers arranged respectively at sides underneath the bottom part, the set of crawlers comprising:

a front crawler;

a rear crawler;

a movable stretching crawler arranged at an outside of the front crawler; and a fixed stair-climbing crawler arranged at an outside of the rear crawler; wherein a pulley at one end of the movable stretching crawler is fixedly connected with a pulley at a front end of the front crawler, and a free end of the movable stretching crawler is rotatable in forward or backward directions with respect to a fixed end of the movable stretching crawler within the range of 360° by means of a control lever; and wherein a pulley at one end of the fixed stair-climbing crawler is fixedly connected with a pulley at a rear end of the rear crawler, while a free end of the fixed stair-climbing crawler is inclined at a specific angle relative to the rear crawler; and components for driving the set of crawlers arranged in the bottom part.

* * * * *